US006089397A

United States Patent [19]

Van Melle

[11] Patent Number: 6,089,397

[45] Date of Patent: Jul. 18, 2000

[54] CUP LID HAVING IMPROVED DRINK-THROUGH OPENING

[75] Inventor: Hugh Van Melle, Etobicoke, Canada

[73] Assignee: Amhil Enterprises, Mississauga, Canada

[21] Appl. No.: 09/288,629

[22] Filed: Apr. 9, 1999

[51] Int. Cl.[7] ..... B65D 17/34

[52] U.S. Cl. ..... 220/270; 220/254; 220/712

[58] Field of Search ..... 220/254, 268, 220/270, 711, 712

[56] References Cited

U.S. PATENT DOCUMENTS

| | | |
|---|---|---|
| 2,003,657 | 6/1935 | Stubblefield . |
| 2,661,889 | 12/1953 | Phinney . |
| 3,800,999 | 4/1974 | Serritella . |
| 3,860,162 | 1/1975 | Schutz . |
| 3,868,043 | 2/1975 | Freemyer . |
| 3,927,794 | 12/1975 | Erdman . |
| 4,056,210 | 11/1977 | Boyle . |
| 4,081,103 | 3/1978 | Zoellick . |
| 4,106,660 | 8/1978 | Boyle . |
| 4,138,033 | 2/1979 | Payne et al. . |
| 4,184,604 | 1/1980 | Amberg et al. . |
| 4,190,174 | 2/1980 | Haimowitz . |
| 4,210,256 | 7/1980 | Amberg et al. . |
| 4,253,582 | 3/1981 | Shields . |
| 4,331,255 | 5/1982 | Fournier . |
| 4,345,695 | 8/1982 | Galloway et al. . |
| 4,350,260 | 9/1982 | Prucher . |
| 4,438,865 | 3/1984 | Scattargia . |
| 4,460,103 | 7/1984 | Rama et al. . |
| 4,489,848 | 12/1984 | Braude . |
| 4,589,569 | 5/1986 | Clements . |
| 4,615,459 | 10/1986 | Clements . |
| 4,629,088 | 12/1986 | Durgin . |
| 4,738,373 | 4/1988 | DeParales . |
| 5,090,584 | 2/1992 | Roberts et al. . |
| 5,111,961 | 5/1992 | Van Melle . |
| 5,197,624 | 3/1993 | Dodaro . |
| 5,490,609 | 2/1996 | Lane et al. . |
| 5,509,568 | 4/1996 | Warden et al. . |
| 5,699,927 | 12/1997 | Lane et al. . |
| 5,839,601 | 11/1998 | Van Melle . |

*Primary Examiner*—Stephen K. Cronin
*Assistant Examiner*—Robin A. Hylton
*Attorney, Agent, or Firm*—Marks & Clerk

[57] ABSTRACT

A disposable cup lid is substantially circular, and has a downwardly facing cup rim engaging recess extending from 300° to 360° around the periphery. The recess is defined at its outer side by a downwardly depending apron, at its inner side by a downwardly directed recess sidewall, and at its top by a top wall between the apron and the recess sidewall. The apron extends 360° around the periphery. An arcuate portion of the top surface extends radially outwardly to the apron, and has a radially directed axis of symmetry. A depressed "U"-shaped hinge is formed in the arcuate portion, and is oriented so as to be perpendicular to the axis of symmetry. A fault line is stamped into the the arcuate portion, in a location opposed to the "U"-shaped hinge, and is spaced radially inwardly from the apron by a distance which is at least equal to the width of the top wall of the cup rim engaging recess. The fault line defines an outer extremity of a tear-back flap which, when torn back, will fold backwardly at the "U"-shaped hinge so as to define a drink-through opening. An upwardly extending lifting stub is formed in the arcuate portion of the top surface, and is such that it may be easily grasped between the thumb and a finger of an adult hand, so that it may be torn back by grasping and lifting the stub, and so as to provide access to the drink-through opening.

20 Claims, 2 Drawing Sheets

CUP LID HAVING IMPROVED DRINK-THROUGH OPENING

FIELD OF THE INVENTION

This invention relates to disposable lids for placement on drinking cups; and, more particularly, the present invention is directed to a disposable lid which has an improved drink-through opening. Lids in keeping with the present invention are particularly notable for the fact that the apron which defines the outer periphery of the lid remains intact at all times, even when a tear-back flap has been folded backwardly so as to provide access to the drink-through opening. Also, the tear-back flap for the drink-through opening may be re-closed, and locked in place.

BACKGROUND OF THE INVENTION

Disposable lids for drinking cups are, of course, very well known. Indeed, disposable lids having drink-through openings are very well known. The advantage of a drink-through opening is that the lid does not need to be removed from the cup in order to drink the beverage which is contained in the cup. This may be particularly advantageous when the beverage is a hot beverage, such as coffee or tea.

For the most part, however, disposable cup lids having a drink-through opening have required that the apron of the cup, which defines its periphery, be broken in order for a tear-back flap to be torn back and folded backwardly so as to reveal the drink-through opening. As soon as the periphery defining apron of the lid is broken, its engagement to the rim of the drinking cup is much less secure. However, the present invention overcomes that difficulty by providing a cup lid having a so-called "plug fit". Moreover, because the periphery defining apron of the cup lid of the present invention remains unbroken and in place on the drinking cup rim at all times, a plug fit may be provided which may extend less than 360° around the periphery.

What is meant by a plug fit is that a recess is formed on the underside of the disposable cup lid, at or very near the outer periphery thereof, and the recess accommodates the lip of the drinking up at both its inside and outside extremities. Thus, the rim of the cup extends upwardly into the recess, which is downwardly directed, and the rim of the cup is much more securely held in place.

Notwithstanding the prior art which is discussed hereafter, the Inventor herein has unexpectedly discovered that disposable cup lids may be provided for placement onto a drinking cup, having a plug fit, and having an unbroken periphery defining apron, where the plane of the substantially circular and substantially planar top surface of the disposable cup lid is at or below the top wall of the downwardly directed recess which provides for the plug fit. Hitherto, most such cup lids that have provided a drink-through opening together with an unbroken periphery defining apron have been dome lids.

DESCRIPTION OF THE PRIOR ART

RAMA et al. U.S. Pat. No. 4,460,103 teaches a drink lid or cover which is particularly intended for use with cups having hot beverages in them. The lid fits snugly to the cup with essentially a plug fit, and provides an openable flap through which ingredients such as cream and sugar may be added to the beverage, and through which the beverage may be consumed. The Rama et al. drink lid is substantially flat, and has an upper surface which extends downwardly into the cup so as to lie below the surface below the rim of the cup.

A raised pull tab is provided to lift the flap so that it may be folded back, after which the pull tab is then inserted into a matching well. The shape of the flap is such that it is curved, having no angular edges.

CLEMENS U.S. Pat. No. 4,589,569 teaches a dome lid which is placed over the rim of a beverage cup, and which extends above the rim of the beverage cup so as to provide additional volume for such purposes as to protect against spillage. Clemens has a preformed punched opening which is very small, and which is located in an elevated rim formed in the cup lid. Several disadvantages arise, including the fact that the preformed opening may not preclude spillage due to jostling of the cup. Moreover, the lid is not plug fitted to the cup, but is merely snapped over the rim of the cup with the engagement between the rim and the cup lid being limited only to the upper and outer portion of the cup rim being contacted by the cup lid. Still further, the very small preformed drinking opening is awkward to use in that it is quite small and, when the beverage is very hot, a thin stream of hot beverage is directed into the mouth of the user. Moreover, the small drinking opening does not permit air to flood back into the cup while the beverage is being consumed, and a vent hole must be provided for that purpose. If the vent hole is poorly formed, or clogged, the beverage must be more or less sucked from the cup through the drinking opening, unless the cup is taken away from the mouth of the user so as to permit air to re-enter the cup through the drinking opening.

LANE et al. U.S. Pat. Nos. 5,490,609 and 5,699,927 have essentially identical disclosures. Each teaches a beverage cup lid which is substantially flat, where the major plane of the cup lid lies below the rim of the cup. The particular feature of the Lane et al. cup lid is that the drink-through opening is covered by a hinged closure member which may be locked in place by trapping an outer marginal edge of the closure between the cup rim and the periphery of the lid. In order to provide such a cup lid, however, the closure member must be manipulated during manufacture of the cup lid, such as by being pulled so as to stretch the plastic material in a radial direction.

U.S. Pat. No. 5,839,601, issued to the Inventor herein, and commonly assigned, teaches a disposable dome lid for drinking cups. The dome lid is configured so as to make a plug fit onto the beverage cup. A side surface of the dome depends downwardly from a substantially planar top surface of the lid, and is inset from the cup rim engaging recess. A portion of that side surface is displaced outwardly towards the outer periphery of the dome lid, and thus provides a surface for engaging the lower lip of the mouth of the user. A tear-back flap is defined by fault lines which are stamped into the top surface, and a "U"-shaped hinge formed in the top surface. The tear-back flap may be folded back and locked into place by placing a locking stub into a locking recess. A drink-through opening is thereby created in the top of the dome lid near the outer periphery thereof, and the lower lip engaging surface is thereby located below the drink-through opening, permitting easy drinking access to the beverage in the cup.

SUMMARY OF THE INVENTION

In accordance with one aspect of the present invention, there are provided two principal embodiments for a disposable cup lid. In the first embodiment, a cup rim engaging recess which provides a plug fit for the disposable cup lid onto the rim of a drinking cup extends entirely around the periphery of the cup lid. In the other principal embodiment, the plug fit which is provided by the inwardly facing cup rim engaging recess extends less than 360° around the periphery, but the periphery-defining apron of the cup remains unbroken even when the tear-back flap has been folded back to allow access to the drink-through opening. However, each of the above referenced principal embodiments of the disposable cup lids in keeping with the present invention may generally be defined in the following manner:

Any disposable cup lid in keeping with the present invention is intended for placement onto a drinking cup having an opening at its upper end, which is defined by a substantially circular cup rim whose upper extremity lies substantially in a single plane. The disposable cup lid will be thermoformed from plastics sheet material, and will comprise: A substantially circular and substantially planar top surface, and a downwardly facing cup rim engaging recess which is formed near the outer periphery of the disposable cup lid.

The cup rim engaging recess extends from 300° to 360° around the periphery of the disposable cup lid, and is defined at its outer side by a substantially circular, downwardly depending apron, and at its inward side by a first downwardly directed recess sidewall.

The downwardly depending apron extends 360° around the periphery of the disposable cup lid.

The cup rim engaging recess has a top wall which extends between the downwardly depending apron and the first downwardly directed recess sidewall.

There is an arcuate portion of the substantially planar top surface which extends radially outwardly to the first downwardly directed recess sidewall. The arcuate portion of the substantially planar top surface has a radially directed axis of symmetry.

A depressed "U"-shaped hinge is formed in the substantially planar top surface in the region thereof which is occupied by the arcuate portion, and the "U"-shaped hinge is oriented so as to be perpendicular to the axis of symmetry of the arcuate portion of the substantially planar top surface.

A first fault line is stamped into the substantially planar top surface in the arcuate portion thereof, in a location which is opposed to the "U"-shaped hinge. The location of the first fault line is spaced radially inwardly from the downwardly directed apron by a distance which is at least equal to the width of the top wall of the cup rim engaging recess. The first fault line defines an outer extremity of a tear-back flap which, when torn back, will fold backwardly at the "U"-shaped hinge and will thereby define a drink-through opening in the substantially planar top surface.

An upwardly extending lifting stub is formed in the arcuate portion of the substantially planar top surface in a location thereof which is between the first fault line and the "U"-shaped hinge. The upwardly extending lifting stub is also located at a defined distance from the "U"-shaped hinge. The dimensions of the lifting stub are such that it may be easily grasped between the thumb and a finger of an adult hand.

Thus, the tear-back flap may be torn back by a grasping and lifting action of the lifting stub, so as to be folded backwardly about the "U"-shaped hinge, and so as to thereby provide access to the drink-through opening.

As noted above, one principal embodiment of the present invention provides that the cup rim engaging recess extends 360° around the periphery of the disposable cup lid. In this case, the location of the first fault line is at a distance from the downwardly directed apron which is greater than the width of the top wall of the cup rim engaging recess.

The plane of the substantially circular and substantially planar top surface may be in the plane of the top wall of the cup rim engaging recess, or it may be below the plane of the top wall of the cup rim engaging recess.

In the other principal embodiment of the present invention, the cup rim engaging recess extends from 300° to 350° around the periphery of the disposable cup lid. Here, a downwardly extending recess is formed in the substantially planar top surface, and it also extends from 300° to 350° around the periphery of the disposable cup lid and inwardly of the cup lid engaging recess.

The downwardly extending recess which is formed in the substantially planar top surface extends below the plane of top wall of the cup rim engaging recess, and below the plane of the substantially planar top surface. That downwardly extending recess is defined at its outer side by the first downwardly directed recess sidewall and at its inner side by a second downwardly directed recess sidewall located radially inwardly from the first downwardly directed recess sidewall.

The arcuate portion of the substantially planar top surface is the 10° to 60° arcuate portion thereof, which is unoccupied by the downwardly extending recess formed in the substantially planar top surface.

The arcuate portion of the substantially planar top surface extends radially outwardly to the downwardly depending apron.

As noted above, the plane of the substantially circular and substantially planar top surface may be located below the plane of the top wall of the cup rim engaging recess. It may also be substantially in the same plane as the top wall of the cup rim engaging surface.

In the second principal embodiment of the present invention, as described above, the arcuate portion of the substantially circular and substantially planar top surface may be in a plane which slopes downwardly and radially inwardly from the downwardly depending apron to the "U"-shaped hinge, with the remainder of the substantially circular and substantially planar top surface being in a plane which is below the plane of the top wall of the cup rim engaging recess.

In any embodiment of the present invention, a locking recess may be formed in the substantially circular and substantially planar top surface at the defined distance from the "U"-shaped hinge but at the opposite side thereof from the lifting stub. The dimensions of the lifting stub and the locking recess are such that the lifting stub may be received in the locking recess when the tear-back flap is folded backwardly about the "U"-shaped hinge.

At least one edge surface of the lifting stub may have a ribbed configuration formed therein for greater stiffness of the lifting stub.

In any embodiment of the present invention, the tear-back flap is defined at its outer extremity by the first stamped fault line; and it may be further defined at its edges by two further stamped edge fault lines which extend away from the respective ends of the fist stamped fault line towards the "U"-shaped hinge, and terminate thereat.

Alternatively, when the disposable cup lid of the present invention is formed from an extruded plastic sheet material having a linear extrusion grain, and is formed so that the axis of symmetry of the arcuate portion is substantially parallel to the linear extrusion grain, the tear-back flap may be defined at its outer extremity by the first stamped fault line and at its sides by tears which form substantially along the extrusion grain from the respective ends of the first stamped fault line towards the "U"-shaped hinge.

A horizontally directed groove may be formed in the face of the lifting stub which is closer to the first stamped fault line.

Matching depressions and pips may be formed in end surfaces of the lifting stub and locking recess, or vice versa, so as to more securely lock the tear-back flap into its folded back configuration.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

Figure 1:
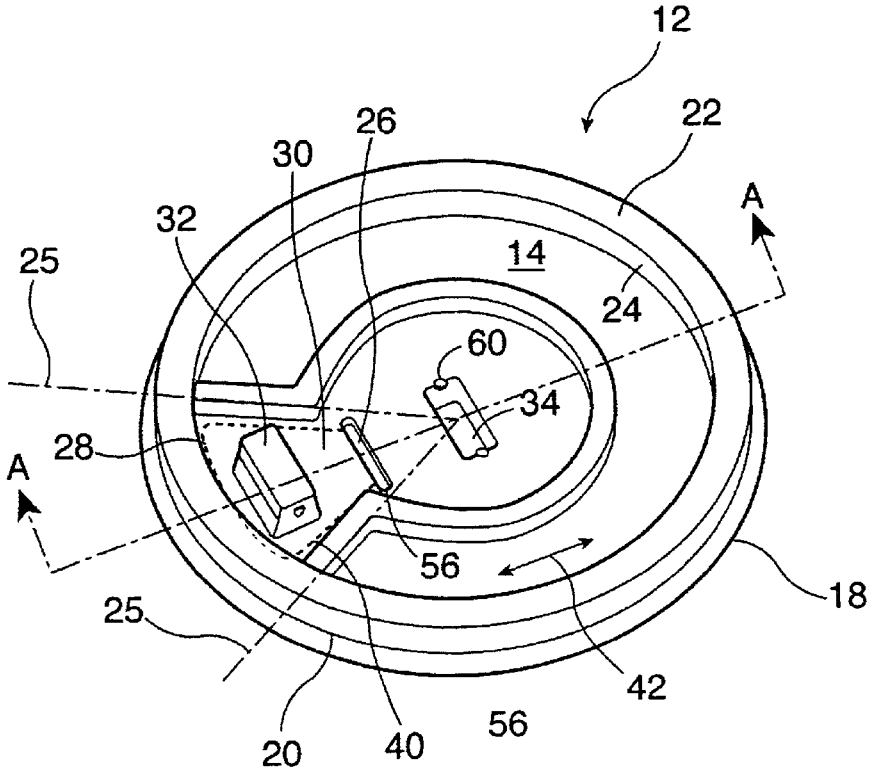
FIG. 1 is a perspective view of a first principal embodiment of a disposable cup lid, in keeping with the present invention.
Figure 3:
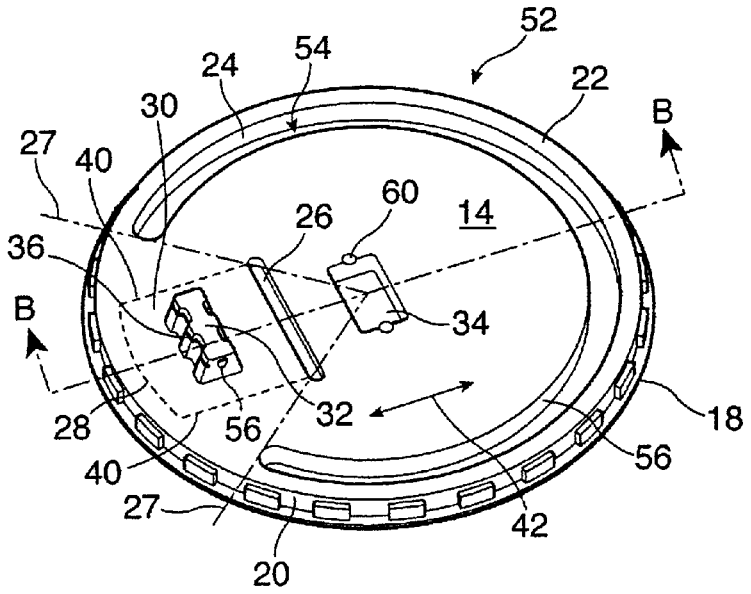
FIG. 3 is a perspective view of a second principal embodiment of disposable cup lid in keeping with the present invention.

There are two principal embodiments of disposable cup lid of the present invention, shown at 12 in FIG. 1 and at 52 in FIG. 3. Each embodiment, and variations thereof, bears a number of features in common, as will be noted by the use of the same reference numerals whenever identical features are being described. However, as will be described in greater detail hereafter, the disposable cup lid 12 of FIG. 1 provides a plug fit entirely around the periphery of the cup lid whereas the disposable cup lid 52 of FIG. 3 provides a plug fit for less than 360°, but more than 300° around the periphery of the cup lid.

Any disposable cup lid in keeping with the present invention is thermoformed from a plastics sheet material. Generally, the plastics sheet material is an extruded polystyrene material, and the thermoforming is carried out by applying a vacuum at one side of the die and pressure against the plastics material on the other side of the die over which the disposable cup lid is formed.

Of course, any disposable cup lid in keeping with the present invention is intended for placement onto a drinking cup which has an opening at its upper end, the opening being defined by a substantially circular cup rim whose upper extremity lies substantially in a single plane. Each disposable cup lid in keeping with the present invention has a substantially circular and substantially planar top surface 14, and a downwardly facing cup rim engaging recess 16 which is formed near the outer periphery 18 of the disposable cup lid.

The downwardly facing cup rim engaging recess 16 will extend from not less than 300° to up to 360° around the periphery of the disposable cup lid 12 or 52. In the case of the disposable cup lid 12, the downwardly facing cup rim engaging recess 16 extends 360° around the periphery of the cup lid; in the case of the disposable cup lid 52, the downwardly facing cup rim engaging recess 16 extends from 300° to 350° around the periphery of the disposable cup lid.

The periphery is defined by a downwardly depending apron 20 which extends 360° around the periphery 18 of any disposable cup lid in keeping with the present invention.

The downwardly facing cup rim engaging recess 16 has a top wall 22, which extends between the downwardly depending apron 20 and a first downwardly directed recess sidewall 24. Thus, the cup rim engaging recess 16 is defined at its outer side by the downwardly depending apron 20, at its inner side by the downwardly directed recess sidewall 24, and at its top by the top wall 22.

There is an arcuate portion of each of the disposable cup lids 12 and 52 which can be said to be defined by the chain lines 25 in FIG. 1 and 27 in FIG. 3. Each arcuate portion 25 or 27 is a portion of the substantially planar top surface 14 of the respective disposable cup lid; and each arcuate portion 25 or 27 extends radially outwardly to the downwardly depending apron 20.

Each arcuate portion 25 or 27 has a radially directed axis of symmetry which, for purposes of the present illustration, may be presumed to reside on the section lines A—A or B—B of FIGS. 1 and 3, respectively.

A depressed "U"-shaped hinge 26 is formed in the substantially planar top surface 14 in the region thereof which is occupied by the respective arcuate portion 25 or 27. The "U"-shaped hinge 26 is oriented so as to be perpendicular to the axis of symmetry of the arcuate portion 25 or 27.

There is a first fault line 28, which is stamped into the planar top surface 14 of any disposable cup lid in keeping with the present invention. The fault line 28 is placed in the arcuate portion 25 or 27, and it is situated in a location which is opposed to the "U"-shaped hinge 26.

The location of the first fault line 28 is spaced radially inwardly from the downwardly directed apron 20 by a distance which is at least equal to the width of the top wall 22 of the cup rim engaging recess 16. In the embodiment of FIG. 1, the fault line 28 is placed slightly more radially inwardly than the width of the top wall 22 of the cup rim engaging recess 16, so as to be placed behind the first downwardly directed recess sidewall 24. The location of the fault line 28 is shown, as well, in each of FIGS. 2, 4, and 5.

Figure 4:
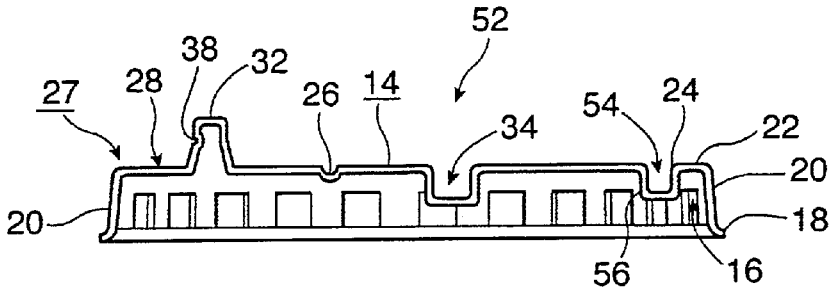
FIG. 4 is a cross-section of a specific embodiment of the disposable cup lid of FIG. 3.
Figure 5:
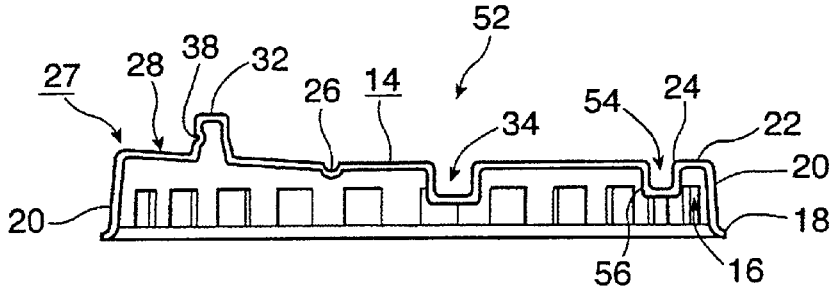
FIG. 5 is a cross-section of another specific embodiment of disposable cup lid of FIG. 3.

The location of the fault line 28 in embodiments of the cup lid of the present invention as shown in FIGS. 3 through 5 is such that it is also spaced inwardly from the downwardly directed apron 20 by a distance which is at least equal to the width of the top wall 22 of the cup rim engaging recess 16. This is so that, when the tear-back flap is torn back so as to provide access to a drink-through opening in a manner described in greater detail hereafter, the outer edge of the drink-through opening will be formed substantially at the inner side of the cup rim of the drinking cup onto which the disposable cup lid 52 has been placed.

In any event, the first fault line 28 defines an outer extremity of a tear-back flap 30. When the tear-back flap 30 is torn back, it will fold backwardly at the "U"-shaped hinge 26 and will thereby define a drink-through opening in the substantially planar top surface 14.

An upwardly extending lifting stub 32 is formed in the arcuate portion 25 or 27 of the respective planar top surface 14 of the disposable cup lid 12 or 52. The location of the lifting stub 32 is between the first fault line 28 and the "U"-shaped hinge 26, at a defined distance from the "U"-shaped hinge 26.

The dimensions of the lifting stub 32 are such that it may be easily grasped between the thumb and a finger of an adult hand.

Thus, the tear-back flap 30 may be torn back by grasping the lifting stub 32 and lifting it so that the tear-back flap 30 will be folded backwardly about the "U"-shaped hinge 26. This, of course, provides access to the drink-through opening.

Figure 2:
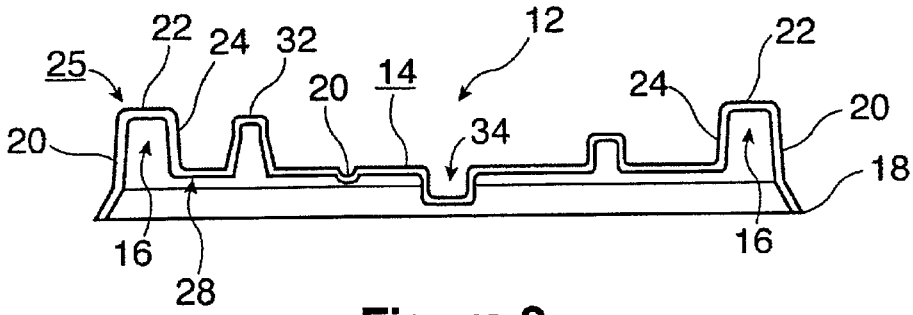
FIG. 2 is a cross-section taken in the direction of arrows A—A in FIG. 1.

Referring specifically to the embodiments of FIGS. 1 and 2, it has been noted that the cup rim engaging recess 16 extends 360° around the periphery of the disposable cup lid 12. It has also been noted that the location of the first fault line 28 is at a distance from the downwardly directed apron 20 which is greater than the width of the top wall 22 of the cup rim engaging recess 16. It will be noted, particularly from FIG. 2, that in general the plane of the substantially circular and substantially planar top surface 14 is below the plane of the top wall 22 of the cup rim engaging recess 16. Thus, the drink-through opening of the disposable cup lid 12 is found below the plane of the top wall 22 of the cup rim engaging recess 16.

A locking recess 34 is formed in the substantially circular and substantially planar top surface 14 at substantially the same defined distance from the "U"-shaped hinge 26 that the lifting stub 32 is placed from the "U"-shaped hinge 26. Of course, the locking recess 34 is positioned at the opposite side of the "U"-shaped hinge 26 from the lifting stub 32. The dimensions of the lifting stub 32 and the dimensions of the locking recess 34 are such that the lifting stub 32 may be received in the locking recess 34, and retained therein, when the tear-back flap 30 is folded backwardly about the "U"-shaped hinge 26.

In some embodiments of the disposable cup lid of the present invention, at least one edge surface of the lifting stub 32 may have a ribbed configuration, as shown at 36 in FIG. 3. The ribbed configuration of lifting stub will provide greater stiffness for the lifting stub 32.

Also, any lifting stub 32 in keeping with the present invention may have a horizontally directed groove 38 formed in the face of the lifting stub 32 which is closer to the first stamped fault line 28. The groove 32 is shown particularly in FIGS. 4 and 5; and it provides an additional physical aid for lifting the lifting stub 32 and tearing back the tear-back flap 30, by being able to position the thumb nail of a user in the groove 38.

In any embodiment of the present invention, the tear-back flap 30 is defined at its outer extremity by the first stamped fault line 28. In some embodiments of the present invention, the tear-back flap 30 may be defined at its edges by two further stamped edge fault lines 40, as shown particularly in FIGS. 1 and 3. Each further stamped edge fault line 40 extends from the respective ends of the first stamped fault line 28 towards the "U"-shaped hinge 26, and each further stamped edge fault line 40 terminates at the "U"-shaped hinge 26.

The tear-back flap 30 can be re-closed, once opened, and re-locked into place so that it will stay closed. This is accomplished by pushing the tear-back flap 30 sown into place covering the drink-through opening, so that the outer edge of the tear-back flap 30 will essentially tuck into place at the fault line 28. The elastic memory of the material of the tear-back flap 30 will try to restore the tear-back flap 30 to its opened configuration. However, in first opening the tear-back flap 30 and the folding it about the "U"-shaped hinge 26, the material of the disposable cup lid may stretch just a little in the region of the "U"-shaped hinge 26 so that, after it has been opened, the length of the tear-back edge may be just slightly longer. Thus, the re-locking of the tear-back flap in place is made possible.

In other embodiments of the present invention, particularly when the disposable cup lid is formed from an extruded plastics sheet material, the extruded plastic sheet material will have a linear extrusion grain shown by arrow 42 in each of FIGS. 1 and 3. The usual material is extruded polystyrene; and it happens that extruded polystyrene will tear more easily along the linear extrusion grain than in any other direction. Thus, if the axis of symmetry of the arcuate portion 25 or 27 is aligned so as to be substantially parallel to the linear extrusion grain of the extruded plastics material, then the tear-back flap 30 can be defined at its outer extremity by the first stamped fault line 28 and at its sides by tears which will form substantially along the extrusion grain from the respective ends of the first stamped fault line 28 towards the "U"-shaped hinge 26.

In the embodiments of FIGS. 3,4, and 5, the cup rim engaging recess 16 extends from 300° to 350° around the periphery of the disposable cup lid 52. A further downwardly extending recess 54 is formed in the substantially planar top surface 14 of the disposable cup lid 52, and it also extends from 300° to 350° around the periphery of the disposable cup lid 52, but inwardly of the cup rim engaging recess 16.

The downwardly extending recess 54 extends below the plane of the top wall 22 of the cup rim engaging recess 22, and it also extends below the plane of the substantially planar top surface 14. The downwardly extending recess 54 is defined at its outer side by the downwardly directed recess sidewall 24, and at its inner side by a second downwardly directed recess sidewall 56.

The arcuate portion 27 of the planar top surface 14 is the 10° to 60° arcuate portion thereof which is unoccupied by the downwardly extending recess 54. Once again, it will be noted that the arcuate portion 27 of the disposable cup lid 52 extends radially outwardly to the downwardly depending apron 20.

In the particular embodiment of the disposable cup lid 52 as shown in FIG. 4, the plane of the substantially circular and substantially planar top surface 14 may be found to be substantially in the same plane as that of the top wall 22 of the cup rim engaging surface 16.

However, in another embodiment of the disposable cup lid 52 as shown in FIG. 5, the arcuate portion 27 of the substantially circular and substantially planar top surface 14 is in a plane which slopes downwardly and radially inwardly from the downwardly depending apron 20 to the "U"-shaped hinge 26. The remainder of the substantially circular and substantially planar top surface 14 is in a plane which is below the plane of the top wall 22 of the cup rim engaging recess 16.

Alternatively, as suggested by FIGS. 2 and 4 together, the plane of the substantially planar top surface 14 may be below the plane of the top wall 22 of the cup rim engaging recess 16, but the downwardly extending recess 54 may extend around the periphery for 300° to 350°. This leaves the arcuate portion 27 in the same plane as the balance of the planar top surface 14, and a small wall may be formed in the outer region of the arcuate portion 27, radially outwardly of the stamped first fault line 28, so as to connect to the top wall 22 in the region of the arcuate portion 27.

In any embodiment of the present invention, matching depressions 56 and pips 60 may be formed in end surfaces of the lifting stub 32 and the locking recess 34. It is evident, of course, that the pips may be formed in the locking stub 32, and the matching depressions formed in the locking recess 34; more usually, the pips 60 are formed in the locking recess 34 and the matching depressions 56 are formed in the end surfaces of the lifting stub 32.

There has been described various embodiments of disposable cup lids for placement onto a drinking cup where, in each case, a drink-through opening is formed in the cup lid in a plane which is either at the level of the top wall of the cup rim engaging recess, or below that plane. Other embodiments and variations to the disposable cup lid in keeping with the present invention may be realized, without departing from the spirit and scope of the appended claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the words "substantial" or "substantially", when used with an adjective or adverb, is intended to enhance the scope of the particular characteristic; e.g., substantially circular means defining a circle or having the property of circularity; likewise, substantially planar means being in a plane or having the general characteristics associated with being planar.

What is claimed is:

1. A disposable cup lid for placement onto a drinking cup having an opening at its upper end, said opening being defined by a substantially circular cup rim whose upper extremity lies substantially in a single plane;

wherein said disposable cup lid is thermoformed from plastics sheet material, and comprises:

substantially circular and substantially planar top surface; and downwardly facing cup rim engaging recess formed near the outer periphery of said disposable cup lid;

wherein said cup rim engaging recess extends from 300° to 360° around the periphery of said disposable cup lid, and is defined at its outer side by a substantially circular, downwardly depending apron, and at its inner side by a first downwardly directed recess sidewall;

wherein said downwardly depending apron extends 360° around the periphery of said disposable cup lid;

wherein said cup rim engaging recess has a top wall which extends between said downwardly depending apron and said first downwardly directed recess sidewall;

wherein there is an arcuate portion of said substantially planar top surface which extends radially outwardly to said downwardly depending apron;

wherein said arcuate portion of said substantially planar top surface has a radially directed axis of symmetry;

wherein a depressed "U"-shaped hinge is formed in said substantially planar top surface in the region thereof occupied by said arcuate portion, and said "U"-shaped hinge is oriented so as to be perpendicular to said axis of symmetry of said arcuate portion of said substantially planar top surface;

wherein a first fault line is stamped into said substantially planar top surface in said arcuate portion thereof, in a location opposed to said "U"-shaped hinge;

wherein said location of said first fault line is spaced radially inwardly from said downwardly directed apron by a distance which is at least equal to the width of said top wall of said cup rim engaging recess, and wherein said first fault line defines an outer extremity of a tear-back flap which, when torn back, will fold backwardly at said "U"-shaped hinge and will thereby define a drink-through opening in said substantially planar top surface;

wherein an upwardly extending lifting stub is formed in said arcuate portion of said substantially planar top surface in a location thereof between said first fault line and said "U"-shaped hinge, and at a defined distance from said "U"-shaped hinge; and wherein the dimensions of said lifting stub are such that the lifting stub may be easily grasped between the thumb and a finger of an adult hand;

whereby said tear-back flap may be torn back by a grasping and lifting action of said lifting stub so as to be folded backwardly about said "U"-shaped hinge, and so as to thereby provide access to said drink-through opening.

2. The disposable cup lid of claim 1, wherein said cup rim engaging recess extends 360° around the periphery of said disposable cup lid; and wherein the location of said first fault line is at a distance from said downwardly directed apron which is greater than the width of said top wall of said cup rim engaging recess.

3. The disposable cup lid of claim 2, wherein the plane of said substantially circular and substantially planar top surface is below the plane of said top wall of said cup rim engaging recess.

4. The disposable cup lid of claim 2, wherein a locking recess is formed in said substantially circular and substantially planar top surface at substantially said defined distance from said "U"-shaped hinge and at the opposite side thereof from said lifting stub; and wherein the dimensions of said lifting stub and said locking recess are such that said lifting stub may be received in said locking recess when said tear-back flap is folded backwardly about said "U"-shaped hinge.

5. The disposable cup lid of claim 2, wherein at least one edge surface of said lifting stub has a ribbed configuration formed therein for greater stiffness thereof.

6. The disposable cup lid of claim 2, wherein said tear-back flap is defined at its outer extremity by said first stamped fault line, and at its edges by two further stamped edge fault lines which extend away from the respective ends of said first stamped fault line towards said "U"-shaped hinge, and terminate thereat.

7. The disposable cup lid of claim 2, when formed from an extruded plastics sheet material having a linear extrusion grain, wherein said axis of symmetry is substantially parallel to said linear extrusion grain, and wherein said tear-back flap is defined at its outer extremity by said first stamped fault line and at its sides by tears which form substantially along said extrusion grain from the respective ends of said first stamped fault line towards said "U"-shaped hinge.

8. The disposable cup lid of claim 2, wherein a horizontally directed groove is formed in the face of said lifting stub which is closer to said first stamped fault line.

9. The disposable cup lid of claim 1, wherein said cup rim engaging recess extends from 300° to 350° around the periphery of said disposable cup lid;

wherein a downwardly extending recess is formed in said substantially planar top surface, and extends from 300° to 350° around the periphery of said disposable cup lid and inwardly of said downwardly facing cup rim engaging recess;

wherein said downwardly extending recess extends below the plane of said top wall of said cup rim engaging recess, and below the plane of said substantially planar top surface, and is defined at its outer side by said first downwardly directed recess sidewall and at its inner side by a second downwardly directed recess sidewall located radially inwardly from said first downwardly directed recess sidewall;

wherein said arcuate portion of said substantially planar top surface is the 10° to 60° arcuate portion thereof which is unoccupied by said downwardly extending recess; and wherein said arcuate portion of said substantially planar top surface extends radially outwardly to said downwardly depending apron.

10. The disposable cup lid of claim 9, wherein the plane of said substantially circular and substantially planar top surface is substantially in the same plane as said top wall of said cup rim engaging surface.

11. The disposable cup lid of claim 9, wherein said arcuate portion of said substantially circular and substantially planar top surface is in a plane which slopes downwardly and radially inwardly from said downwardly depending apron to said "U"-shaped hinge, and the remainder of said substantially circular and substantially planar top surface is in a plane which is below the plane of said top wall of said cup rim engaging recess.

12. The disposable cup lid of claim 9, wherein a locking recess is formed in said substantially circular and substantially planar top surface at substantially said defined distance from said "U"-shaped hinge and at the opposite side thereof from said lifting stub; and wherein the dimensions of said lifting stub and said locking recess are such that said lifting stub may be received in said locking recess when said tear-back flap is folded backwardly about said "U"-shaped hinge.

13. The disposable cup lid of claim 9, wherein at least one edge surface of said lifting stub has a ribbed configuration formed therein for greater stiffness thereof.

14. The disposable cup lid of claim 9, wherein said tear-back flap is defined at its outer extremity by said first stamped fault line, and at its edges by two further stamped edge fault lines which extend away from the respective ends of said first stamped fault line towards said "U"-shaped hinge, and terminate thereat.

15. The disposable cup lid of claim 9, when formed from an extruded plastics sheet material having a linear extrusion grain, wherein said axis of symmetry is substantially parallel to said linear extrusion grain, and wherein said tear-back flap is defined at its outer extremity by said first stamped fault line and at its sides by tears which form substantially along said extrusion grain the respective ends of said first stamped fault line towards said "U"-shaped hinge.

16. The disposable cup lid of claim 9, wherein a horizontally directed groove is formed in the face of said lifting stub which is closer to said first stamped fault line.

17. The disposable cup lid of claim 2, when formed from an extruded plastics sheet material having a linear extrusion grain, wherein said axis of symmetry is substantially parallel to said linear extrusion grain, and wherein said tear-back flap is defined at its outer extremity by said first stamped fault line and at its sides by tears which form substantially along said extrusion grain from the respective ends of said first stamped fault line towards said "U"-shaped hinge.

18. The disposable cup lid of claim 1, wherein a locking recess is formed in said substantially circular and substantially planar top surface at substantially said defined distance from said "U"-shaped hinge and at the opposite side thereof from said lifting stub.

19. The disposable cup lid of claim 18, wherein matching depressions and pips are formed in the end surfaces of said lifting stub and said locking recess, respectively, so as to more securely lock said tear-back flap into its folded back configuration.

20. The disposable cup lid of claim 18, wherein matching depressions and pips are formed in the end surfaces of said locking recess and said lifting stub, respectively, so as to more securely lock said tear-back flap into its folded back configuration.

* * * * *